US006852000B2

(12) United States Patent
Lee et al.

(10) Patent No.: US 6,852,000 B2
(45) Date of Patent: Feb. 8, 2005

(54) BEACH WAVE PLAYSET

(76) Inventors: Robert Stephen Lee, 690 Bluegrass St., Simi Valley, CA (US) 93065; Robert William Engel, 548 N. Hollyburne La., Thousand Oaks, CA (US) 91360; William John Kelley, 1952 Corbett Highlands Pl., Arroyo Grande, CA (US) 93420

( * ) Notice: Subject to any disclaimer, the term of this patent is extended or adjusted under 35 U.S.C. 154(b) by 0 days.

(21) Appl. No.: 10/361,949

(22) Filed: Feb. 10, 2003

(65) Prior Publication Data

US 2003/0236048 A1 Dec. 25, 2003

Related U.S. Application Data

(60) Provisional application No. 60/355,762, filed on Feb. 9, 2002, now abandoned.

(51) Int. Cl.[7] ..... A63H 3/52

(52) U.S. Cl. ..... 446/476; 446/484; 446/156

(58) Field of Search ..... 446/70–71, 91, 446/153, 156, 158, 176, 484, 268; 40/79; 472/117, 116, 128

(56) References Cited

U.S. PATENT DOCUMENTS

| | | | | | |
|---|---|---|---|---|---|
| 3,802,697 | A | * | 4/1974 | Le Mehaute | 482/51 |
| 5,667,445 | A | * | 9/1997 | Lochtefeld | 472/117 |
| 5,738,590 | A | * | 4/1998 | Lochtefeld | 472/117 |
| 6,336,771 | B1 | * | 1/2002 | Hill | 405/79 |
| 6,491,589 | B1 | * | 12/2002 | Lochtefeld | 472/117 |

* cited by examiner

*Primary Examiner*—Derris H. Banks
*Assistant Examiner*—J Williams
(74) *Attorney, Agent, or Firm*—O'Connell Law Firm

(57) ABSTRACT

A beach wave playset for simulating an approach of a wave toward a shoreline. The playset can have a beach member, a wave member, and a pivot axle for enabling the wave member to pivot into and out of proximity with the beach member. Decorative elements, such as surfboards, dolls, and inner tubes, can be retained relative to the wave member and can be moved, such as by a drive wheel and motion conversion assembly combination, during a pivoting of the wave member to enable a realistic wave riding simulation. A plurality of water panels can simulate an underlying water surface. The wave member could be moved manually or by a motor arrangement, and electronic play effects could be induced in response to a movement of the wave member.

35 Claims, 6 Drawing Sheets

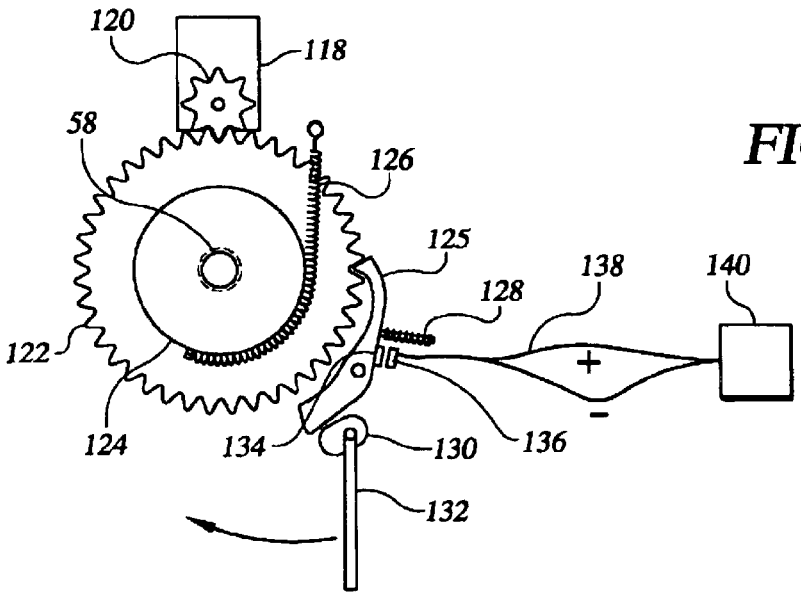
FIG.7
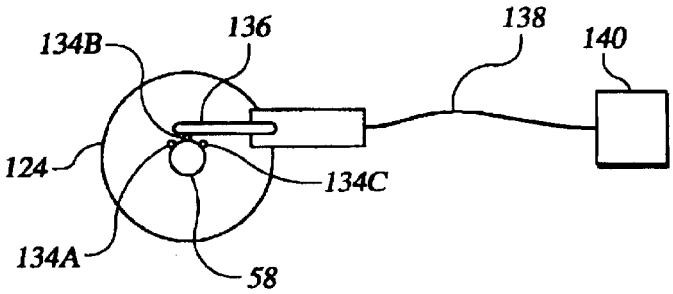
FIG.8
FIG.9
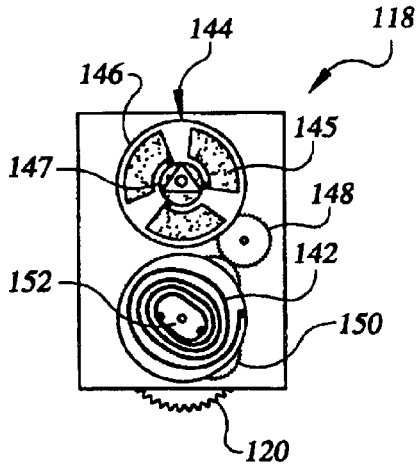

BEACH WAVE PLAYSET

PRIORITY INFORMATION

This application claims priority to U.S. Provisional Patent Application No. 60/355,762, filed Feb. 9, 2002 now abandoned.

FIELD OF THE INVENTION

The present invention relates generally to playset arrangements. Stated more particularly, this patent discloses and protects a playset construction enabling the simulation of a given environment, such as a beach environment, with play effects, such as the rolling of a beach wave onto a sandy shoreline.

BACKGROUND OF THE INVENTION

Numerous playset constructions have been disclosed by the prior art. The playsets of the prior art have often shared common goals, such as providing the user with enjoyment, diversion, and possibly education. Undeniably, the inventors of such constructions have contributed usefully to the state of the art. Nonetheless, there continues to remain a need in the present field of endeavor for playset constructions that advance beyond the prior art in providing unique and entertaining movements and effects.

SUMMARY OF THE INVENTION

The present invention is founded on a most basic object of providing a playset that represents a useful advance over the playsets of the prior art.

A further object of the invention is to provide a playset that can enable unique play effects.

Another object of certain embodiments of the invention is to provide a playset that can simulate the approach of a wave toward a shoreline.

Yet another object of particular embodiments of the invention is to provide a playset that can provide action effects in supplementation of a simulated wave approaching a shoreline.

These and further objects and advantages of the invention will become obvious not only to one who reviews the present specification and drawings but also to one who has an opportunity to make use of an embodiment of the present invention for a beach wave playset. However, it will be appreciated that, although the accomplishment of each of the foregoing objects in a single embodiment of the invention may be possible and indeed preferred, not all embodiments will seek or need to accomplish each and every potential object and advantage. Nonetheless, all such embodiments should be considered to be within the scope of the present invention.

In carrying forth these and further objects, a most basic embodiment of the invention for a playset can take the form of a beach wave playset for simulating an approach of a wave toward a shoreline. The beach wave playset can have a first playset member, which can comprise a beach member with an upper housing simulating a sandy beach portion, and a second playset member, which can comprise a wave member with an upper housing simulating one or more waves. A means can be provided for enabling at least a portion of the wave member to be moved into and out of proximity with the beach member.

The wave member could further include a means for retaining a decorative element and, possibly, a means for inducing a movement of the means for retaining a decorative element relative to the wave member in response to a movement of the wave member. That means for inducing a movement of the means for retaining a decorative element could take the form of a means for mechanically converting a movement of the wave member into a movement of the means for retaining a decorative element.

In one embodiment of the playset, the means for converting a movement of the wave member into a movement of the means for retaining a decorative element could comprise a wheel rotatably retained by the wave member for contact with an underlying surface in combination with a motion conversion assembly for converting a rotation of the wheel into a movement of the means for retaining a decorative element. The motion conversion assembly could include a rod eccentrically disposed on a member that is rotated by a rotation of the wheel in combination with a support member that retains the means for retaining a decorative element. The support member can be pivotally retained for lateral pivoting relative to the wave member and the rod can be slidably received in a slot in the support member. Under such a construction, a rotation of the wheel will yield a circular movement of the rod which will induce the rod to reciprocate within the slot thereby inducing a lateral pivoting of the support member and a back and forth rocking motion of the means for retaining a decorative element. In an alternative construction, the support member can be longitudinal pivotable and the rod can be slidably associated with an eccentrically disposed follower that is retained to pivot with the support member. Under this construction, a rotation of the wheel will yield a circular movement of the rod which will induce the rod to slide along the follower thereby inducing a longitudinal pivoting of the support member and a lateral pivoting of the means for retaining a decorative element.

The playset can incorporate a wide variety of suitably crafted decorative elements, such as surfboards, dolls, inner tubes, umbrellas, and still other elements. For example, where the decorative element comprises a surfboard, the surfboard can be retained relative to the wave member by the means for retaining a decorative element. When so retained, the surfboard can be moved in response to a movement of the wave member thereby enabling a simulation of a surfer riding a wave toward a shoreline.

The appearance of the playset can be enhanced with the provision of a simulated water surface that can be disposed under the wave member. In one example of the invention, the simulated water surface can be formed by a plurality of simulated water panels. A pocket can be provided in the beach member for retaining the water panels in a storage configuration. Under one embodiment of the invention, the wave member and the water panels can be pivotally coupled to the beach member such that the water panels can be fanned out under the wave member. Means, such as opposed protuberances, can be provided for preventing each of the plurality of water panels from pivoting out of continuity with one another.

While the wave member could be manually pivoted into and out of proximity with the beach member, certain embodiments of the beach wave playset can incorporate a drive arrangement, such as a winding motor drivingly associated with the wave member, for pivoting the wave member toward the beach member. In one such embodiment, the winding motor can be drivingly associated with the wave member such that a pivoting of the wave member away from the beach member will induce an energizing or winding of the winding motor and such that an unwinding of the winding motor will tend to pivot the wave member toward the beach member. The angular speed of the wave member can be controlled by a dampening governor operably associated with the winding motor so that the simulated wave can approach the simulated beach in a smooth and realistic manner.

In an even further refinement of the invention, a latching arrangement can be incorporated for selectively locking the wave member in a given angular orientation relative to the beach member. For example, where the winding motor is drivingly associated with the wave member by a gear combination, the latching arrangement can comprise a latching member that is pivotable into and out of restrictive engagement with the gear combination.

Still other embodiments of the invention can include a means for inducing electronic play effects in response to a movement of the wave member relative to the beach member. In one such construction, the play effects can be dependent on a disposition of the wave member relative to the beach member. For example, where the wave member pivots about a pivot axle, a plurality of electrical contacts can be angularly spaced over the pivot axle and an overlying electrical contact can make contact with one or more of the electrical contacts depending an angular orientation of the wave member relative to the beach member. With that, electrically associated playset electronics can induce play effects that correspond to the orientation of the wave member.

One will appreciate that the foregoing discussion broadly outlines the more important features of the invention to enable a better understanding of the detailed description that follows and to instill a better appreciation of the inventors' contribution to the art. Before an embodiment of the invention is explained in detail, it must be made clear that the following details of construction, descriptions of geometry, and illustrations of inventive concepts are mere examples of the many possible manifestations of the invention.

BRIEF DESCRIPTION OF THE DRAWINGS

In the accompanying drawing figures:

FIG. 7 is a top plan view of latching and switching arrangements according to the present invention;

FIG. 8 is a top plan view of an alternative switching arrangement pursuant to the present invention; and FIG. 9 is a partially disassembled top plan view of a drive motor with an internal governor usable with the present invention.

DETAILED DESCRIPTION OF PREFERRED EMBODIMENTS

Figure 1:
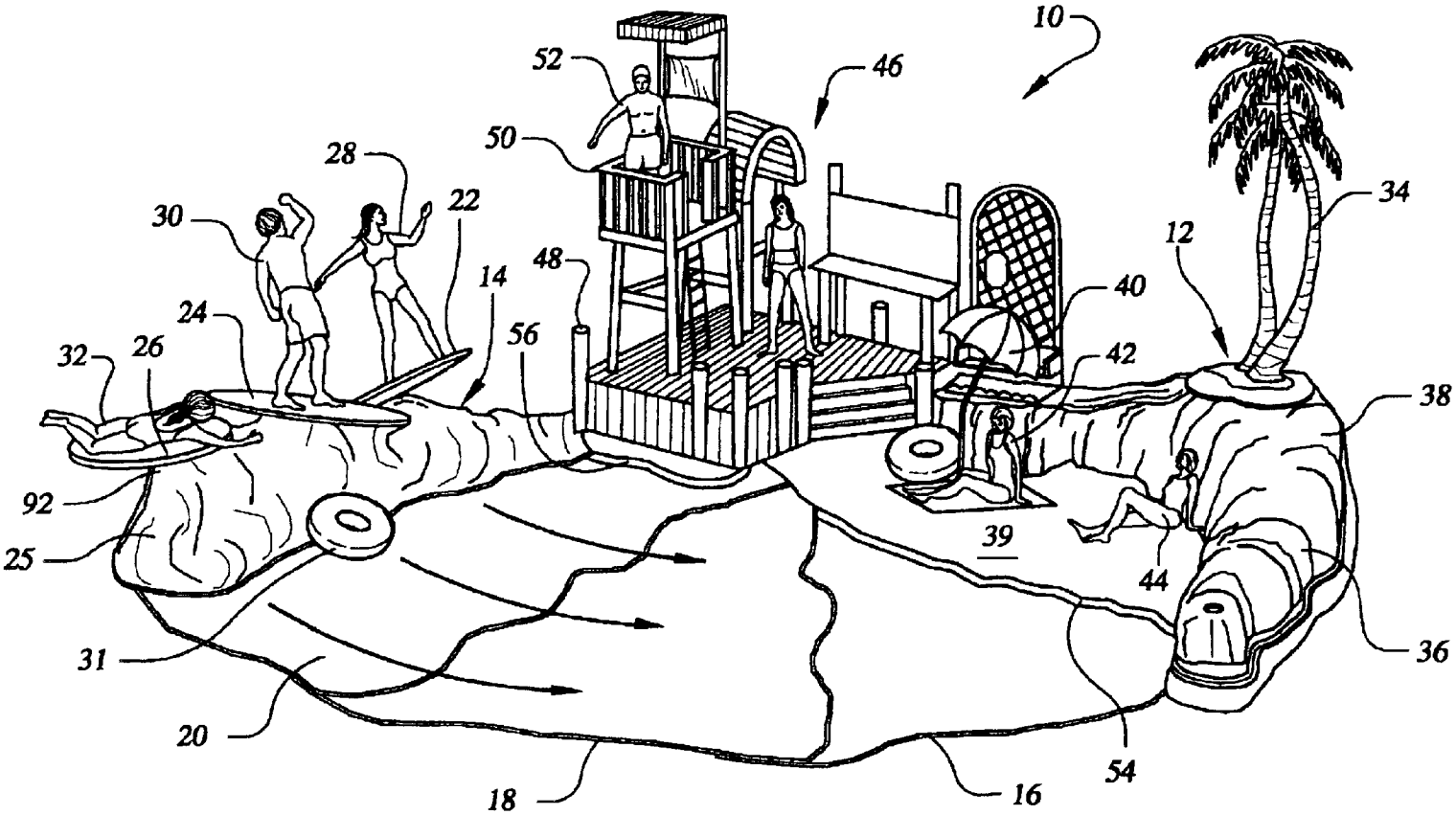
FIG. 1 is a perspective view of a beach wave playset according to the present invention with the wave member in a fully extended disposition.
Figure 2:
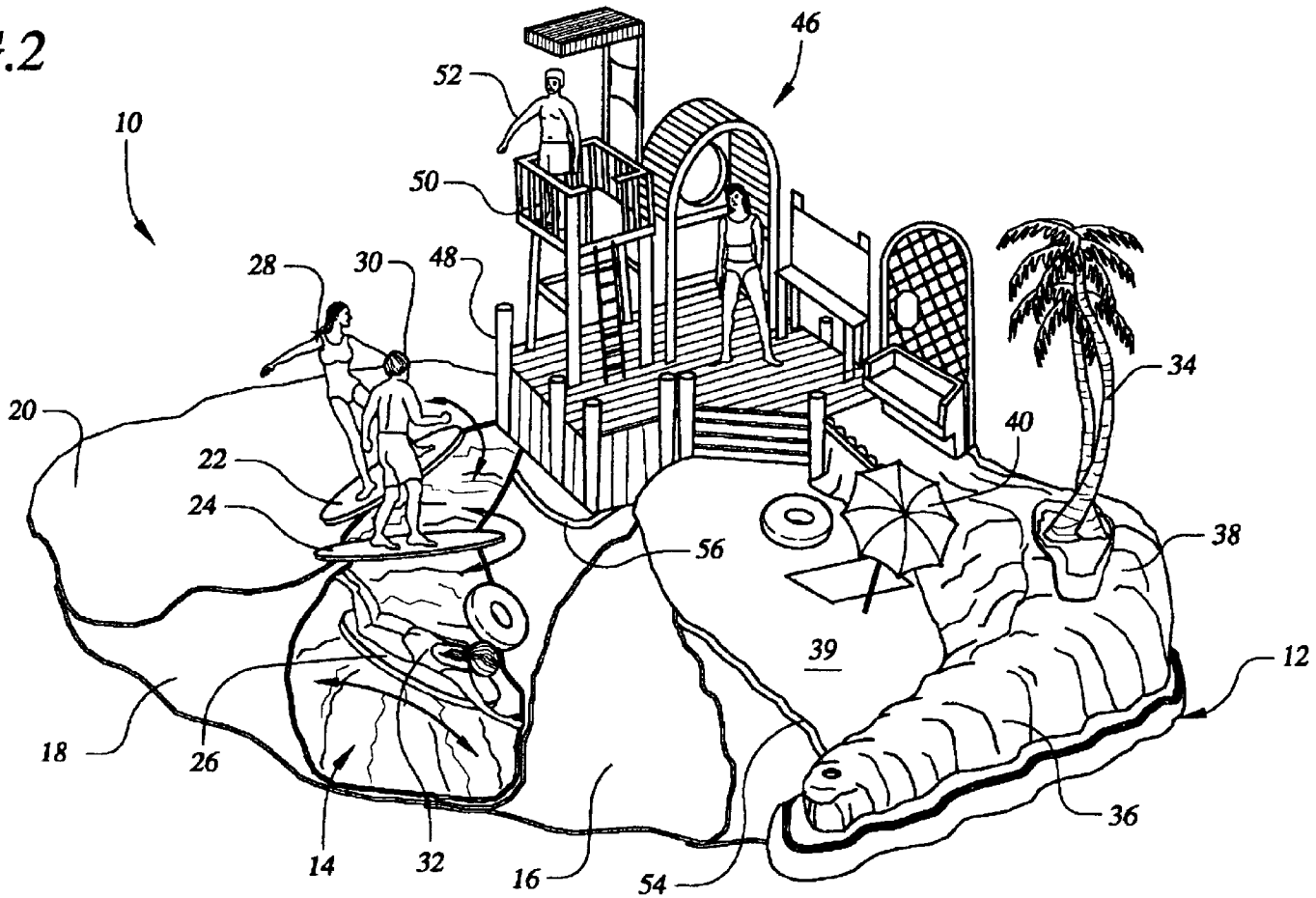
FIG. 2 is a perspective view of the beach wave playset of FIG. 1 with the wave member in a partially extended disposition.

As with many inventions, the present invention for a beach wave playset can assume a wide variety of embodiments. However, to assist those reviewing the present disclosure in understanding and, in appropriate circumstances, practicing the present invention, certain exemplary embodiments of the beach wave playset are described below and shown in the accompanying drawing figures.

With this in mind, one can have particular reference to the drawings where an exemplary embodiment of a playset according to the present invention is indicated generally at 10 in FIGS. 1 through 5. While it must be appreciated that the playset 10 could take many forms and could simulate numerous different playset scenes and environments, the playset 10 in this example simulates a beach wave playset arrangement. The beach wave playset 10 has a beach member 12 with an upper housing 36 that is crafted, such as by molding, carving, forming, decorating, or by any other method or combination of methods, to simulate a length of a beach environment. The beach wave playset 10 further includes a wave member 14 with an upper housing 25 that is crafted, again possibly by molding, carving, forming, or by any other method or combination of methods, to have the general shape and appearance of one or more waves. As will be described further below, the wave member 14 is movably associated with the beach member 12 to move or be moved into and out of proximity therewith under any effective motion including, by way of example, pivoting, rotation, linear translation, or any other relative movement or combination of movements. Employing this arrangement, the beach wave playset 10 can advantageously simulate the rolling advance of a wave onto a beach as the wave member 14 advances toward the waiting beach member 12.

In furtherance of the invention's simulation of a beach environment, the depicted example of the upper housing 36 of the beach member 12 has a portion simulating a sandy beach 39 that leads to a sand dune 38. The sandy beach 39 portion of the beach member 12 and the inner edge of the wave member 14 are correspondingly shaped and contoured to enable intimate contact therebetween as is shown, for example, in FIGS. 3 and 4. Further decorative elements beyond the sandy beach 39 and the sand dune 38 can be crafted into, coupled to, or simply disposed on the upper housing 36. For example, one or more palm trees 34 could be disposed atop the sand dune 38 while a plurality of dolls 42 and 44 can be rested on the sandy beach 39. An umbrella 40 can be received into or disposed on the sandy beach 39 for providing shelter to one or more of the dolls 42 and 44.

Figure 6A:
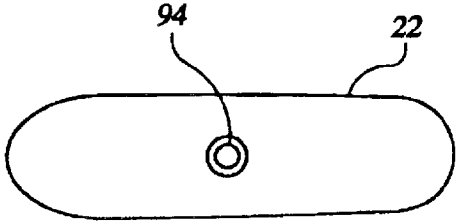
FIG. 6A is a bottom plan view of a surfboard decorative element pursuant to the present invention.
Figure 6B:
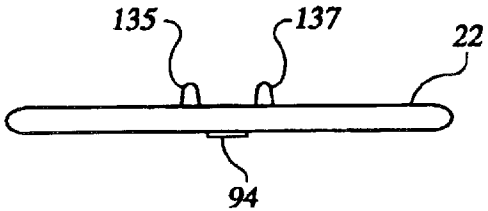
FIG. 6B is a view in side elevation of the surfboard decorative element of FIG. 6A.

Further contributing to the realistic and entertaining simulation provided by the playset 10, the wave member 14 not only has an upper housing 25 that simulates the general shape and appearance of one or more waves but it also incorporates one or more means for retaining decorative elements. Those decorative elements could, of course, be of substantially any appearance and structure. In this case, the wave member 14 has three means for retaining decorative elements, which in this case comprise first, second, and third surfboards 22, 24, and 26. Each of the surfboards 22, 24, and 26 in turn incorporates a means for retaining a doll such that first, second, and third dolls 28, 30, and 32 can be supported by the first, second, and third surfboards 22, 24, and 26 respectively. The dolls 28, 30, and 32 can be retained in a number of different configurations and orientations by any appropriate means including possibly by male projections 135 and 137 extending from the surfboards 22, 24, and 26 as is shown in FIG. 6B that can be matingly engaged with recesses provided in the dolls 28, 30, and 32. Even further still, decorative elements, such as inner tubes 31, boats, or other elements, can be simply rested adjacent to or on the inner side of the wave member 14 to be propelled by the wave member 14 during a pivoting movement thereof.

Figure 3:
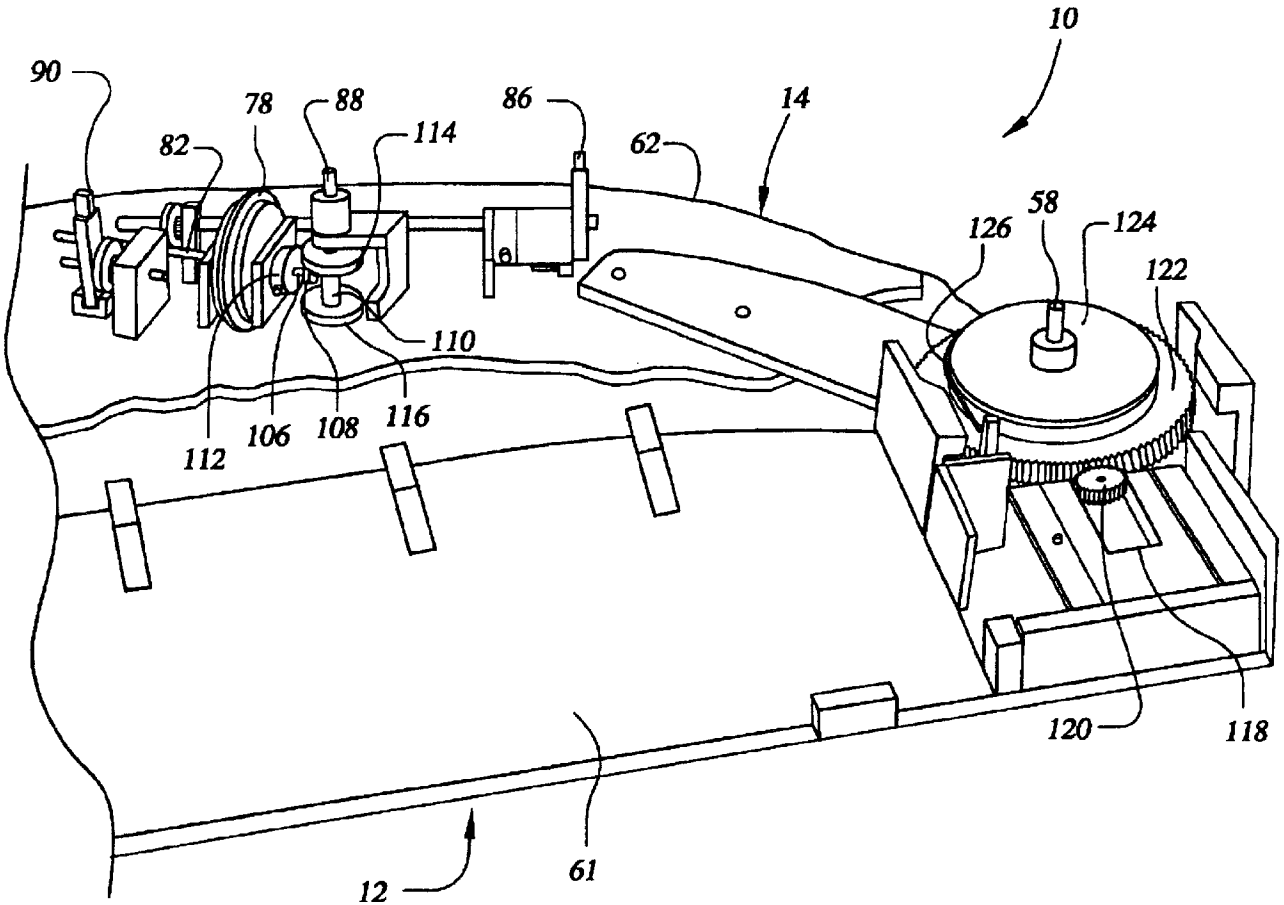
FIG. 3 is a perspective view of a portion of an embodiment of the beach wave playset with the upper housings of the wave member and the beach member removed.
Figure 4:
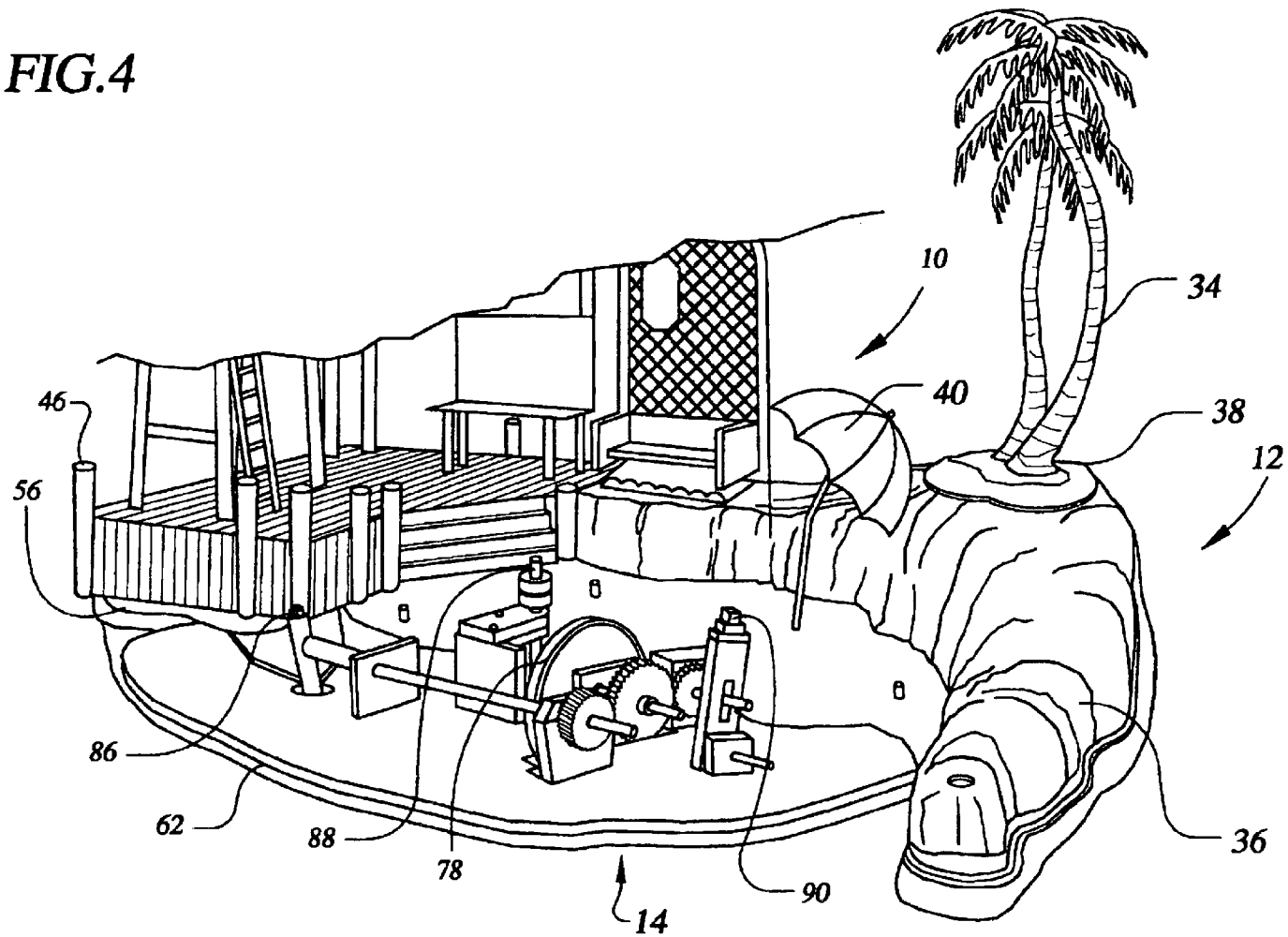
FIG. 4 is a perspective view of an embodiment of the beach wave playset with the upper housing of the wave member removed.

As can be understood most clearly with further reference to FIG. 3 where the beach member 12 and the wave member 14 are shown devoid of their respective upper housings 36 and 25 and with reference to FIG. 4 where just the wave member 14 is shown devoid of its upper housing 25, the wave member 14 and the beach member 12 are movably associated in this exemplary embodiment by a pivoting coupling. With this, the wave member 14 can be pivoted at its proximal end about a pivot axle 58 relative to the beach member 12 between an open position as is shown in FIG. 1 and a closed position as is shown, for example, in FIGS. 3 and 4 where the wave member 14 and thus the simulated wave come into contact or proximity with the beach member 12 and thus the simulated sandy beach 39. When the wave member 14 and the beach member 12 are so pivoted, the simulated wave of the wave member 14 will appear to approach and roll onto the simulated beach 39 of the beach member 12.

A proximal housing portion 46, which can be formed integrally with or separately from the upper housing 36 of the beach member 12, overlies the proximal ends of the beach member 12 and the wave member 14. As with the beach member 12 and the wave member 14, the proximal housing portion 46 could take a wide variety of forms. In this example, the proximal housing portion 46 simulates a segment of a boardwalk with a dock portion 48, a lifeguard stand 50, and other decorative elements. For example, one or more dolls 52 simulating lifeguards and other persons and elements can be disposed on the dock portion 48, the lifeguard stand 50, and other portions of the simulated boardwalk. An arm slot 56 is disposed in the proximal housing portion 46 for accommodating the pivoting of the wave member 14.

The beach wave playset 10 can additionally include a simulation of a water surface over which the wave member 14 can travel thereby further improving the ability of the playset 10 to simulate a beach scene. In the depicted embodiment, the simulated water surface is carried forth by a plurality of appropriately contoured and decorated water panels. In this case, first, second, and third water panels 16, 18, and 20 are retained for independent pivoting relative to the pivot axle 58. Of course, fewer or more water panels could well be provided. With additional reference to FIG. 5, one sees that the beach member 12 has a pocket 54 formed therein between a lower base plate 60 and an upper base plate 61 that supports the upper housing 36 for receiving the water panels 16, 18, and 20 when they are pivoted to what can be considered a collapsed condition. The water panels 16, 18, and 20 can be pivoted to the fanned configuration shown, for example, in FIGS. 1, 2, and 5 by being pulled from within the pocket 54.

Figure 5:
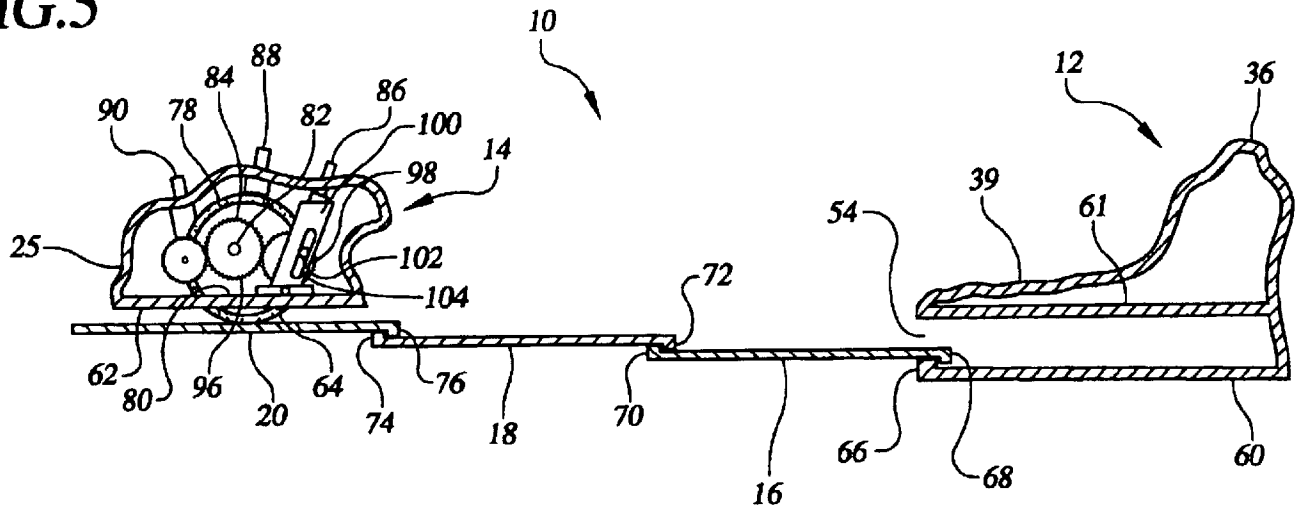
FIG. 5 is a sectioned view in side elevation of an embodiment of the beach wave playset under the present invention.

Advantageously, a fanned configuration wherein the water panels 16, 18, and 20 present a contiguous simulated water surface is facilitated by catches between the adjacent edges of succeeding panels and between the proximal edge of the first water panel 16 and the beach member 12. Such an engagement of the water panels 16, 18, and 20 and the beach member 12 could be carried out in a number of ways. As is shown in FIG. 5, this exemplary embodiment interconnects the water panels 16, 18, and 20 and the beach member 12 by opposed lip or catch configurations. More particularly, the lower base plate 60 of the beach member 12 has an upwardly projecting lip 66 while the edge of the overlying first water panel 16 has a downwardly projecting lip 68 such that the first water panel 16 is prevented from being entirely withdrawn from the beach member 12. Similarly, the overlapping of the first and second water panels 16 and 18 is ensured by opposed lips 70 and 72 while the overlapping of the second and third water panels 18 and 20 is ensured by opposed lips 74 and 76. Under such an arrangement, a user can pull the water panels 16, 18, and 20 from a collapsed configuration within the pocket 54 to provide an expansive, continuous simulated water surface simply by pulling on the outer edge of the third water panel 20 to pivot it out of the pocket 54 until its lip 76 reaches the lip 74 of the outer edge of the second water panel 18 whereupon the second water panel 18 will be pulled from within the pocket 54 until the lip 72 on the inner edge of the second water panel 18 contacts the lip 70 on the outer edge of the first water panel 16 whereupon it too will be withdrawn from the pocket 54 until the lip 68 on its inner edge reaches the lip 66 on the lower base plate 60 thereby preventing further withdrawal of the first water panel 16.

Therefore, as it pivots relative to the beach member 12, the simulated wave provided by the wave member 14 travels over the simulated water surface provided by the water panels 16, 18, and 20. As can be seen best in FIG. 5, the wave member 14 has a base arm 62 that supports the upper housing 25. The base arm 62 and the wave member 14 in general could travel over the water panels 16, 18, and 20 or any other underlying surface under any appropriate method including by sliding over the underlying surface or by simply traveling over the underlying surface with a gap therebetween. In this embodiment, however, the body portion of the wave member 14 is supported at least in part by a wave action drive wheel 78 that is rotatably retained by the base arm 62 within the upper housing 25. The wave action drive wheel 78 projects from within the upper housing 25 through a slot 80 to make contact with the water panels 16, 18, and 20 or any other underlying surface. The wave action drive wheel 78 can incorporate a means for enhancing the tendency of the wave action drive wheel 78 to rotate in registration with the underlying surface, such as by having a high friction peripheral surface of, for example, rubber.

The means for retaining decorative elements relative to the wave member 14 in this embodiment comprise first, second, and third connectors 86, 88, and 90 that project from within the upper housing 25 through corresponding apertures such as that indicated at 92 in FIG. 1. The apertures 92 could comprise slots, round openings, or any other aperture types. The shape of the apertures 92 could be designed to correspond to a movement to be exhibited by the connectors 86, 88, and 90. In this case, the first, second, and third connectors 86, 88, and 90 comprise male projections that can be matingly received into female recesses in the decorative element, such as the female recess 94 in the first surfboard 22 shown in FIG. 6A.

The beach wave playset 10 can incorporate a means for inducing a movement of the connectors 86, 88, and 90, and thus the retained decorative elements, in response to a rotation of the wave action drive wheel 78. Of course, the responsive movements of the connectors 86, 88, and 90 could be of a variety of types and could be induced in numerous different ways that would be within the scope of the present invention. In this example, the first connector 86 is induced by a suitable motion conversion assembly to rock back and forth in response to a rotation of the drive wheel 78. The second connector 88 is induced to pivot laterally about a given pivot axis. The third connector 90 is caused to rock back and forth across the wave member 14 by a suitable mechanical motion conversion assembly. With this, the retained surfboards 22, 24, and 26 and the supported surfing dolls 28, 30, and 32 can mimic actual surfing movements most closely as the wave member 14 rolls over the first, second, and third water panels 16, 18, and 20.

The rocking movement of the first and third connectors 86 and 90 could be carried out essentially as is illustrated relative to the third connector 90 in FIG. 5. In this embodiment, the rocking is induced by a rod 102 that projects eccentrically from a driven gear 98 to engage a slot 104 in a support member 100 that is laterally pivotable relative to the base arm 62. The driven gear 98 is driven by a drive gear 84 that rotates with the drive wheel 78 on the drive wheel axle 82. Under this arrangement, a rotation of the drive wheel 78 as it rolls over an underlying surface will cause a rotation of the drive gear 84 with a consequent rotation of the driven gear 98. As the driven gear 98 rotates, the rod 102 will follow a circular path while sliding along the slot 104 and causing the support member 100, the third connector 90, and any retained decorative element to rock back and forth.

The pivoting movement of the second connector 88 is enabled by a rod 106 that projects eccentrically from a disc 112 that is fixed to rotate with the drive wheel axle 82. The second connector 88 is retained by a support member 110 that is longitudinally pivotable. A follower 108 is retained to pivot with the support member 110 by first and second discs 114 and 116. The follower 108 is disposed generally parallel to the pivot axis of the support member 110 and is biased into contact with the rod 106. With such a construction, a rotation of the drive wheel 78 will yield a rotation of the disc 112 and a circular movement of the rod 106. The follower 108 will ride along the rod 106 thereby causing the support member 110, the second connector 88, and any retained decorative element to pivot laterally.

The pivoting of the wave member 14 could well be carried out manually by, for example, a force input by a user, such as by pushing, cranking, or another method. The pivoting could alternatively be induced by a self-propelling drive arrangement of any appropriate type. For example, an electric motor drive arrangement could be employed, as could a mechanical drive arrangement. One stored energy drive arrangement is shown in FIG. 3. There, a wave gear 122 is fixed to rotate with the base arm 62 of the wave member 14. A winding type drive motor 118 is engaged with the wave gear 122 and thus the wave member 14 by a drive gear 120 such that a pivoting of the wave member 14 will induce a winding of the motor 118 and a driving rotation of the drive gear 120 by operation of the motor 118 will induce a pivoting of the wave member 14. With this interengagement of the wave member 14 and the drive arrangement, a user can input energy into the drive arrangement by a pivoting of the wave member 14 away from the beach member 12 against the force of the motor 118 thereby to wind the motor 118. With the wave member 14 pivoted through a given angular range away from the beach member 12 and the motor 118 wound thereby, the potential energy of the motor 118 can be employed to induce a rotation of the drive gear 120 and the wave gear 122 thereby to cause a pivoting of the wave member 14 toward the beach member 12. A biasing member 126 can if necessary or desirable be incorporated such as by overlying a torque disk 124 to assist the motor 118 in pivoting the wave member 14 toward the beach member 12.

The drive arrangement can further incorporate a dampening governor for limiting the angular speed of the drive gear 120 of the motor 118 and thus the wave member 14 so that the simulated wave will approach the sandy beach 39 in a slow, smooth, and realistic manner. The dampening governor could be incorporated directly into the compartment of the motor 118, or it could be an external governor. Similarly, any necessary speed reduction could be incorporated either internally or externally to the compartment of the motor 118.

The workings of one possible drive motor 118 incorporating a dampening governor are shown in FIG. 9. There, the drive motor 118 stores energy by use of a coil spring 142 that is engaged with the drive gear 120 either by being coaxial therewith or by gearing 150 to adjust the winding speed of the winding axle 152 of the coil spring 142 in relation to the rotational velocity of the drive gear 120. The winding axle 152 of the coil spring 142 is further engaged with a rotary speed governor 144 by gearing 148 that adjusts the relative rotational velocities of the rotary speed governor 144 and the winding axle 152. The rotary speed governor 144 has a plurality of contacts 145 of a high friction material, such as rubber, pivotally coupled to its axle 147 and an annular peripheral wall 146 disposed in proximity to the contacts 145.

Under this arrangement, the coil spring 142 can be wound by a rotation of the drive gear 120 thereby to retain a quantity of potential energy. When released, the coil spring 142 will tend to unwind thereby turning the drive gear 120 and also the rotary speed governor 144. At a given angular velocity, the contacts 145 of the rotary speed governor 144 will pivot under centrifugal force away from the axle 147 and into frictional contact with the peripheral wall 146 thereby limiting or governing the rotational velocity of the rotary speed governor 144, the winding axle 152 of the coil spring 142, the drive gear 120, and, therefore, the wave gear 122 and the wave member 14.

A latching arrangement, such as the exemplary arrangement shown in FIG. 7, can be employed to retain the wave member 14 in a given orientation relative to the beach member 12. The latching arrangement can comprise a ratchet and pawl combination wherein a pivotable latching member 125 having a first tip end is biased into locking engagement with the wave gear 122 by a biasing member 128 and a second end that is in contact with a cam member 130 that can be manipulated by an actuating lever 132. With such a latching arrangement, the user can unlock the wave member 14 for pivoting by a simple pivoting of the actuating lever 132. In the present playset environment, the actuating lever 132 can be appropriately integrated into, for example, the proximal housing portion 46.

In certain embodiments, the beach wave playset 10 could further incorporate a means for inducing electronic play effects, such as sounds, lights, and, additionally or alternatively, movements to supplement the mechanical effects provided by, for example, the movements of the wave member 14 and the first, second, and third connectors 86, 88, and 90. The means for inducing electronic play effects could be carried out in numerous different ways. For example, as is shown in FIG. 7, an electrical contact 134 could be disposed on the latching member 125 while a corresponding electrical contact 136 could be disposed in proximity thereto such that a contact therebetween could be induced by a movement of the latching member 125 in response to a pivoting of the actuating lever 132. The electrical contacts 134 and 136 could be electrically associated with playset electronics 140 by appropriate wiring 138 or the like. With this, voices, beach sounds, and other play effects can be induced during a movement or pivoting of the wave member 14 when the latching member 125 is actuated out of engagement with the wave gear 122.

The means for inducing electronic play effects could induce play effects that are dependent on the angular orientation of the wave member 14 relative to the beach member 12. While a number of such means would be possible and within the scope of the invention, one possible arrangement is shown in FIG. 8 where first, second, and third electrical contacts 134A, 134B, and 134C are spaced over the pivot axle 58 and where an overlying electrical contact 136 is biased into proximity with the pivot axle 58. With such an arrangement, play effects could be induced by the playset electronics 140 that are dependent on the electrical contact or contacts 134A, 134B, and 134C contacted by the overlying electrical contact 136 and that are thus dependent on the angular disposition of the wave member 14.

Use of an embodiment of the present invention for a beach wave playset 10 can begin with the playset 10 in a fully collapsed configuration where the wave member 14 is folded into contact with the beach member 12 and where the first, second, and third water panels 16, 18, and 20 are retained at least partially in the pocket 54. A user can then pull the water panels 16, 18, and 20 from within the pocket to fan them out and to form a continuous simulated water surface. Whether before, after, or simultaneously with the unfolding of the water panels 16, 18, and 20, the wave member 14 can be pivoted away from the beach member 12 to a partially or fully opened orientation. As the wave member 14 is so pivoted, the motor 118 will be wound and thereby energized by the intermeshing of the drive gear 120 with the wave gear 122. The wave member 14 can be maintained in the pivoted disposition by the engagement of the latching member 125 with the wave gear 122.

Decorative elements, such as the surfboards 22, 24, and 26, the dolls 28, 30, 32, 42, and 52, inner tubes 31 and the like, and any other desired elements can be coupled to or rested on the wave member 14 and the beach member 12 to complete the beach scene. When the user so desires, the actuating lever 132 can be pivoted to induce the latching member 125 out of engagement with the wave gear 122. With this, the motor 118 will tend to rotate the drive gear 120 which will rotate the wave gear 122 thereby producing a pivoting of the wave member 14 toward the beach member 12. Advantageously, the angular speed of the wave member 14 will be tempered by operation of the dampening governor so that the oncoming simulated wave will roll onto the sandy beach 39 in a smooth and realistic manner.

As the wave member 14 approaches the beach member 12, the drive wheel 78 will roll over the fanned out water panels 16, 18, and 20 thereby inducing a movement of the first, second, and third connectors 86, 88, and 90 and thus the surfboards 22, 24, and 26 and the dolls 28, 30, and 32 retained thereon. For example, the doll 30 riding the second surfboard 24 will surf the simulated wave while pivoting laterally while the dolls 28 and 32 will surf the simulated wave while rocking back and forth over its crest. The inner tube 31 and any other elements disposed on or near the inner edge of the wave member 14 will be pushed over the simulated water surface toward the simulated shoreline. While the wave member 14 is pivoting, the playset electronics 140 can induce further play effects that can depend on the orientation of the wave member 14 and, additionally or alternatively, the connectors 86, 88, and 90 or any other playset element. When the user is finished playing or when the playset 10 is to be packaged or shipped, the wave member 14 can be brought into intimate contact with the beach member 12 and the water panels 16, 18, and 20 can be pivoted into the pocket 54 so that the beach wave playset 10 will present a most compact configuration.

With certain exemplary embodiments of the present invention for a beach wave playset disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all features of the preferred embodiments.

Therefore, the following claims are intended to define the scope of protection to be afforded to the inventors. However, those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also equivalents thereof.

We claim as deserving the protection of Letters Patent:

1. A beach wave playset for simulating an approach of a wave toward a shoreline, the beach wave playset comprising:

a beach member;

a wave member wherein the wave member has an upper housing that simulates one or more waves; and a means for enabling at least a portion of the wave member to be moved into and out of proximity with the beach member thereby to simulate an approach of a wave toward a shoreline.

2. A beach wave playset for simulating an approach of a wave toward a shoreline, the beach wave playset comprising:

a beach member;

a wave member;

a means for retaining a decorative element relative to the wave member;

a means for enabling at least a portion of the wave member to be moved into and out of proximity with the beach member thereby to simulate an approach of a wave toward a shoreline; and a means for inducing a movement of the means for retaining a decorative element relative to the wave member in response to a movement of the wave member relative to the beach member.

3. The beach wave playset of claim 2 wherein the means for inducing a movement of the means for retaining a decorative element comprises a means for mechanically converting a movement of the wave member into a movement of the means for retaining a decorative element.

4. The beach wave playset of claim 3 wherein the means for converting a movement of the wave member into a movement of the means for retaining a decorative element comprises a wheel rotatably retained by the wave member for contact with an underlying surface in combination with a motion conversion assembly for converting a rotation of the wheel into a movement of the means for retaining a decorative element.

5. The beach wave playset of claim 4 wherein the motion conversion assembly comprises a rod eccentrically disposed on a member that is rotated by a rotation of the wheel in combination with a support member that retains the means for retaining a decorative element wherein the support member is pivotally retained for lateral pivoting relative to the wave member and wherein the rod is slidably received in a slot in the support member whereby a rotation of the wheel will yield a circular movement of the rod that will induce the rod to reciprocate within the slot to induce a lateral pivoting of the support member and a back and forth rocking motion of the means for retaining a decorative element.

6. The beach wave playset of claim 4 wherein the motion conversion assembly comprises a rod eccentrically disposed on a member that is rotated by a rotation of the wheel in combination with a support member that retains the means for retaining a decorative element wherein the support member is pivotally retained for longitudinal pivoting relative to the wave member and wherein the rod is slidably associated with an eccentrically disposed follower that is retained to pivot with the support member whereby a rotation of the wheel will yield a circular movement of the rod that will induce the rod to slide along the follower to induce a longitudinal pivoting of the support member and a lateral pivoting of the means for retaining a decorative element.

7. The beach wave playset of claim 3 further comprising a decorative element for being retained by the means for retaining a decorative element wherein the decorative element comprises a simulated surfboard whereby, when the simulated surfboard is retained by the means for retaining a decorative element, the simulated surfboard will move in response to a movement of the wave member thereby enabling a simulation of a surfer riding a wave toward a shoreline.

8. A beach wave playset for simulating an approach of a wave toward a shoreline, the beach wave playset comprising:

a beach member:

a wave member:

a simulated water surface for underlaying at least the wave member wherein the simulated water surface is formed by a plurality of simulated water panels; and a means for enabling at least a portion of the wave member to be moved into and out of proximity with the beach member thereby to simulate an approach of a wave toward a shoreline.

9. The beach wave playset of claim 8 further comprising a pocket in the beach member for retaining the plurality of simulated water panels in a storage configuration.

10. The beach wave playset of claim 8 wherein the means for enabling at least a portion of the wave member to be moved into and out of proximity with the beach member comprises a means for pivotally coupling the wave member to the beach member and wherein each of the plurality of water panels is pivotally coupled to the beach member.

11. The beach wave playset of claim 10 further comprising means for preventing each of the plurality of water panels from pivoting out of continuity with each adjacent water panel.

12. The beach wave playset of claim 11 wherein the means for preventing each of the plurality of water panels from pivoting out of continuity with each adjacent water panel comprises opposed protuberances on adjacent water panels.

13. A beach wave playset for simulating an approach of a wave toward a shoreline, the beach wave playset comprising:

a beach member;

a wave member; and a means for enabling at least a portion of the wave member to be moved into and out of proximity with the beach member thereby to simulate an approach of a wave toward a shoreline, the means comprising a pivotal coupling of the wave member and the beach member whereby the wave member can be pivoted into and out of proximity with the beach member.

14. The beach wave playset of claim 13 further comprising a drive arrangement for pivoting the wave member toward the beach member.

15. The beach wave playset of clam 14 wherein the drive arrangement comprises a winding motor drivingly associated with the wave member.

16. The beach wave playset of claim 15 wherein the winding motor is drivingly associated with the wave member wherein a pivoting of the wave member away from the beach member will induce an energizing of the winding motor and wherein an unwinding of the winding motor will tend to pivot the wave member toward the beach member.

17. The beach wave playset of claim 16 further comprising a dampening governor operably associated with the winding motor for limiting the angular speed of the wave member during a pivoting of the wave member by the winding motor.

18. The beach wave playset of claim 17 wherein the dampening governor comprises a rotary speed governor with at least one contact pivotally coupled to an axle and an annular peripheral wall disposed in proximity to the at least one contact whereby a rotation of the rotary speed governor can induce the at least one contact to pivot into frictional contact with the peripheral wall thereby governing the rotational velocity of the rotary speed governor, the winding motor, and the wave member.

19. The beach wave playset of claim 15 further comprising a latching arrangement for selectively locking the wave member in a given angular orientation relative to the beach member.

20. The beach wave playset of claim 19 wherein the winding motor is drivingly associated with the wave member by a gear combination with a drive gear rotatably driven by the winding motor that is intermeshed with a wave gear that is fixed for rotation with the wave member and wherein the latching arrangement comprises a latching member that is pivotable into and out of restrictive engagement with the gear combination.

21. A beach wave playset for simulating an approach of a wave toward a shoreline, the beach wave playset comprising:

a beach member;

a wave member;

a means for enabling at least a portion of the wave member to be moved into and out of proximity with the beach member thereby to simulate an approach of a wave toward a shoreline; and a means for inducing electronic play effects in response to a movement of the wave member relative to the beach member.

22. The beach wave playset of claim 21 wherein the means for inducing electronic play effects in response to a movement of the wave member relative to the beach member comprises a means for producing electronic play effects that are dependent on a disposition of the wave member relative to the beach member.

23. The beach wave playset of claim 22 wherein the wave member is pivotally coupled to the beach member by a pivot axle, wherein a plurality of electrical contacts are angularly spaced over the pivot axle, and wherein an overlying electrical contact makes contact with one or more of the electrical contacts depending an angular orientation of the wave member relative to the beach member.

24. A beach wave playset for simulating an approach of a wave toward a shoreline, the beach wave playset comprising:

a beach member with a portion simulative of a segment of a beach;

a wave member with a portion simulative of at least one wave wherein the wave member is pivotally coupled to the beach member whereby the wave member can be pivoted into and out of proximity with the beach member to simulate an approach of a wave toward a shoreline;

a means for retaining a decorative element relative to the wave member; and a means for converting a movement of the wave member relative to the beach member into a movement of the means for retaining a decorative element.

25. The beach wave playset of claim 24 wherein the means for converting a movement of the wave member into a movement of the means for retaining a decorative element comprises a wheel rotatably retained by the wave member for contact with an underlying surface in combination with a motion conversion assembly for converting a rotation of the wheel into a movement of the means for retaining a decorative element.

26. The beach wave playset of claim 24 further comprising a decorative element for being retained by the means for retaining a decorative element wherein the decorative element comprises a simulated surfboard whereby, when the simulated surfboard is retained by the means for retaining a decorative element, the simulated surfboard will move in response to a movement of the wave member thereby enabling a simulation of a surfer riding a wave toward a shoreline.

27. The beach wave playset of claim 24 further comprising a simulated water surface for underlying at least the wave member.

28. The beach wave playset of claim 27 wherein the simulated water surface is formed by a plurality of simulated water panels that are pivotally retained relative to the beach member whereby the simulated water panels can be fanned out to simulate a continuous water surface.

29. A playset comprising:

a first playset member;

a second playset member pivotally coupled to the first member whereby the second playset member can be pivoted into and out of proximity with the first playset member;

a means for retaining a decorative element relative to the second playset member; and a means for converting a movement of the second playset member relative to the first playset member into a movement of the means for retaining a decorative element relative to the second playset member.

30. The playset of claim 29 wherein the means for converting a movement of the second playset member relative to the first playset member into a movement of the means for retaining a decorative element comprises a wheel rotatably retained by the second playset member for contact with an underlying surface in combination with a motion conversion assembly for converting a rotation of the wheel into a movement of the means for retaining a decorative element.

31. The playset of claim 30 wherein the motion conversion assembly comprises a rod eccentrically disposed on a member that is rotated by a rotation of the wheel in combination with a support member that retains the means for retaining a decorative element wherein the support member is pivotally retained for lateral pivoting relative to the second playset member and wherein the rod is slidably received in a slot in the support member whereby a rotation of the wheel will yield a circular movement of the rod that will induce the rod to reciprocate within the slot to induce a lateral pivoting of the support member and a back and forth rocking motion of the means for retaining a decorative element.

32. The playset of claim 30 wherein the motion conversion assembly comprises a rod eccentrically disposed on a member that is rotated by a rotation of the wheel in combination with a support member that retains the means for retaining a decorative element wherein the support member is pivotally retained for longitudinal pivoting relative to the second playset member and wherein the rod is slidably associated with an eccentrically disposed follower that is retained to pivot with the support member whereby a rotation of the wheel will yield a circular movement of the rod that will induce the rod to slide along the follower to induce a longitudinal pivoting of the support member and a lateral pivoting of the means for retaining a decorative element.

33. The playset of claim 29 further comprising a decorative element for being retained by the means for retaining a decorative element whereby, when the decorative element is retained by the means for retaining a decorative element, the decorative element will move in response to a pivoting of the second playset member.

34. The playset of claim 29 further comprising a means for inducing electronic play effects in response to a pivoting of the second playset member relative to the first playset member.

35. The playset of claim 34 wherein the means for inducing electronic play effects in response to a pivoting of the second playset member relative to the first playset member comprises a means for producing electronic play effects that are dependent on a disposition of the second playset member relative to the first playset member.

* * * * *